US011802672B1

(12) United States Patent
Ramsdell

(10) Patent No.: US 11,802,672 B1
(45) Date of Patent: Oct. 31, 2023

(54) SOLAR-POWERED LIGHTING SYSTEM

(71) Applicant: William Ramsdell, Las Vegas, NV (US)

(72) Inventor: William Ramsdell, Las Vegas, NV (US)

( * ) Notice: Subject to any disclaimer, the term of this patent is extended or adjusted under 35 U.S.C. 154(b) by 0 days.

(21) Appl. No.: 17/876,045

(22) Filed: Jul. 28, 2022

Related U.S. Application Data

(60) Provisional application No. 63/312,336, filed on Feb. 21, 2022.

(51) Int. Cl.
*F21S 9/03* (2006.01)
*F21Y 115/10* (2016.01)

(52) U.S. Cl.
CPC ..... *F21S 9/037* (2013.01); *F21Y 2115/10* (2016.08)

(58) Field of Classification Search
CPC ..... F21S 9/037; F21Y 2115/10; F21L 4/08
See application file for complete search history.

(56) References Cited

U.S. PATENT DOCUMENTS

| | | | | |
|---|---|---|---|---|
| 4,382,317 | A | 5/1983 | Stackpole | |
| 4,484,104 | A | 11/1984 | O'Brien | |
| 7,731,383 | B2 | 6/2010 | Myer | |
| 7,863,829 | B2 | 1/2011 | Sayers et al. | |
| 7,988,320 | B2 | 8/2011 | Brumels | |
| 8,833,985 | B2 | 9/2014 | Robertson et al. | |
| 2007/0285023 | A1* | 12/2007 | Cooper | F21L 4/00 362/183 |
| 2008/0029035 | A1* | 2/2008 | Gou | A01K 39/012 362/253 |
| 2008/0232094 | A1* | 9/2008 | Ramsdell | F21S 8/088 362/183 |
| 2014/0153226 | A1* | 6/2014 | Hoang | F03D 9/007 362/183 |
| 2015/0021990 | A1 | 1/2015 | Myer et al. | |
| 2021/0302015 | A1* | 9/2021 | Moufawad | F21V 33/0032 |

* cited by examiner

*Primary Examiner* — Tracie Y Green
*Assistant Examiner* — Michael Chiang
(74) *Attorney, Agent, or Firm* — Robert Brownstein

(57) ABSTRACT

The invention herein disclosed is a solar-powered lighting system optimized to convert light energy into electrical energy, store that electrical energy during daylight hours, and use stored electrical energy to power an LED light source during darkness hours.

1 Claim, 5 Drawing Sheets

SOLAR-POWERED LIGHTING SYSTEM

TECHNICAL FIELD

The invention is a system for converting sunlight to electrical energy, storing that energy and providing light during darkness hours.

BACKGROUND OF INVENTION

So-called solar panels are well known. These panels convert light energy into direct-current electrical energy. The energy produced during daylight hours can be stored in a rechargeable battery for use during darkness hours. Light sources using light-emitting diodes (LEDs) produce a more efficient source of light energy than incandescent light sources. Thus a combination of solar panels charging a battery during daylight hours and providing energy to an LED light source during darkness hours can provide a relatively efficient means of lighting without need to connect the system to a utility power source.

BRIEF DESCRIPTION OF INVENTION

The invention herein disclosed and claimed is a light system comprising solar panels, control electronics, and at least one LED light source. It is designed to be attached to a rigid pole such that the solar panels receive an optimal amount of light energy during the daylight hours, and a storage battery stores and sources electrical energy to an LED light source during darkness hours.

DETAILED DESCRIPTION OF INVENTION

Figure 1:
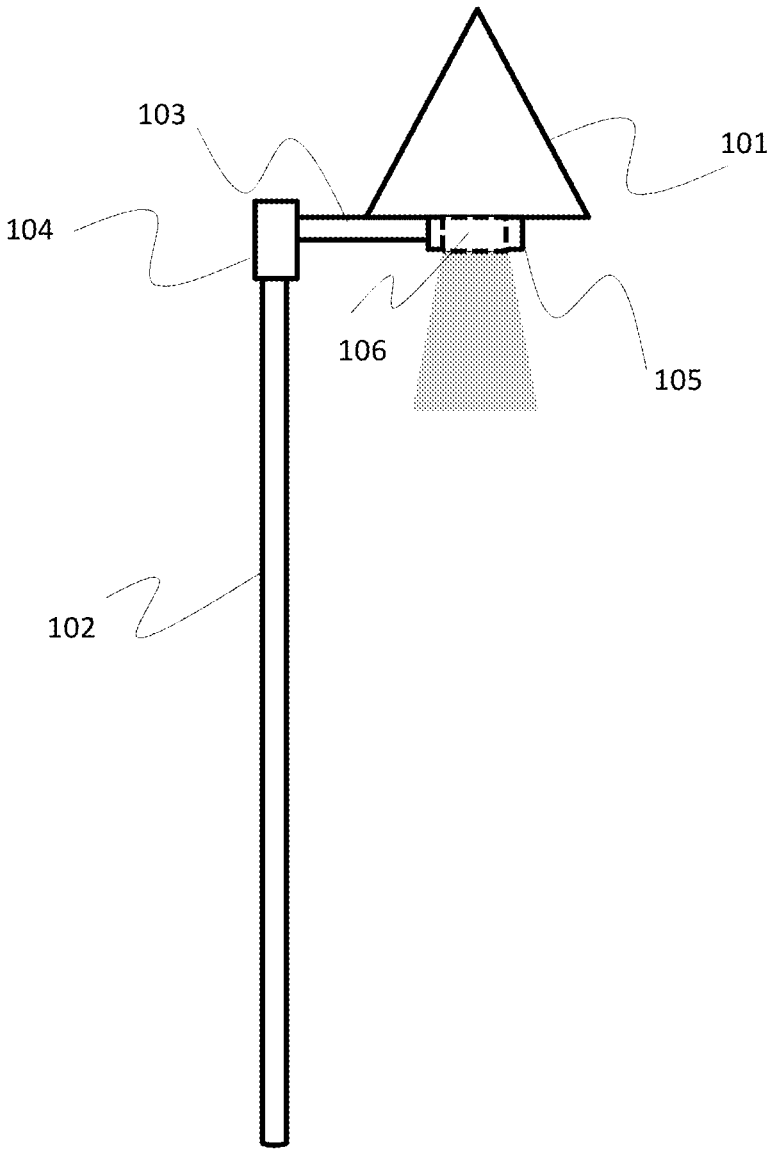
FIG. 1 shows one embodiment of the solar-powered lighting system invention.

FIG. 1 shows an embodiment of the solar-powered lighting system. A set of three triangular solar panels and one solid triangular access door form a pyramid of the four triangular components (101). A base, oriented horizontally with a circular opening and cylindrical extension (105) is the foundation upon which the three solar panels and access door are mounted. A smaller, cylindrical, light-diffusion fixture is attached to and centered in the base (106). An attachment arm (103) extends horizontally from the base to provide an attachment means to a vertically oriented mounting pole (102), and a mounting fixture (104) is operative to provide a firm coupling of the attachment arm and the tip of the mounting pole.

Figure 2:
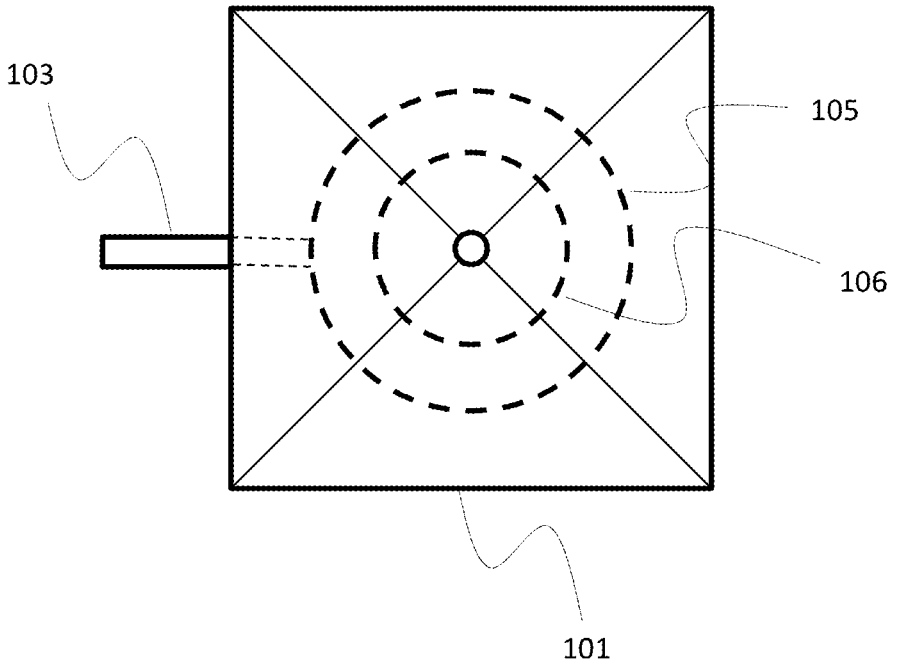
FIG. 2 illustrates a top-down view of the embodiment of FIG. 1.

When viewed from above (e.g. top-down), FIG. 2, the pyramid-shaped structure comprising three solar panels and access door (101) has an apex that is centered above the base and its circular opening (105) and the cylindrical light diffuser (106).

Figure 3:
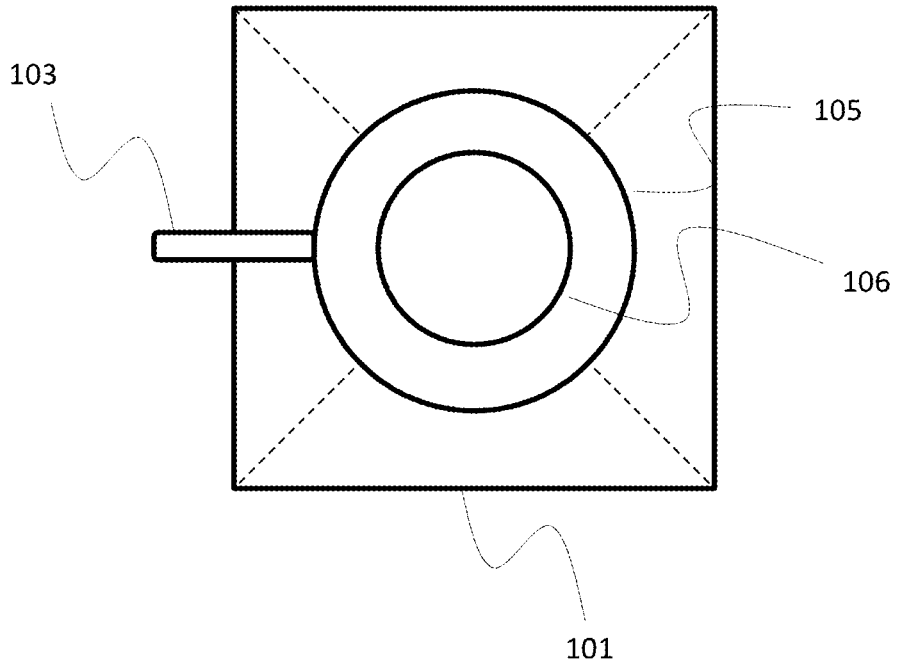
FIG. 3 illustrates a bottom-up view of the embodiment of FIG. 1

When viewed from below (e.g. bottom-up), FIG. 3, the base's circular opening (105) and the cylindrical light diffuser (106) and attachment arm (103) are shown.

Figure 4:
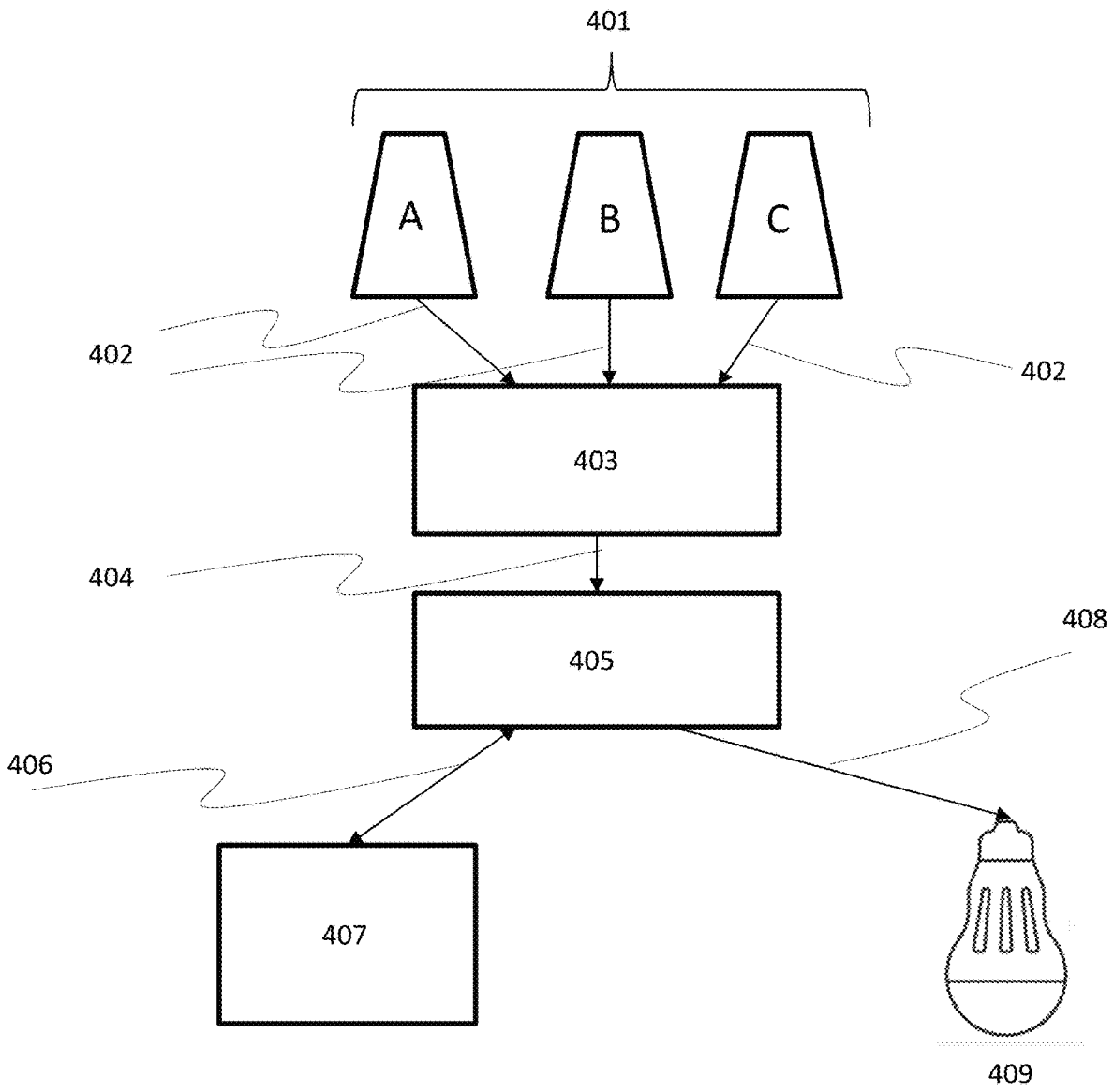
FIG. 4 is a schematic of the components comprising the embodiment of FIG. 1.
Figure 5:
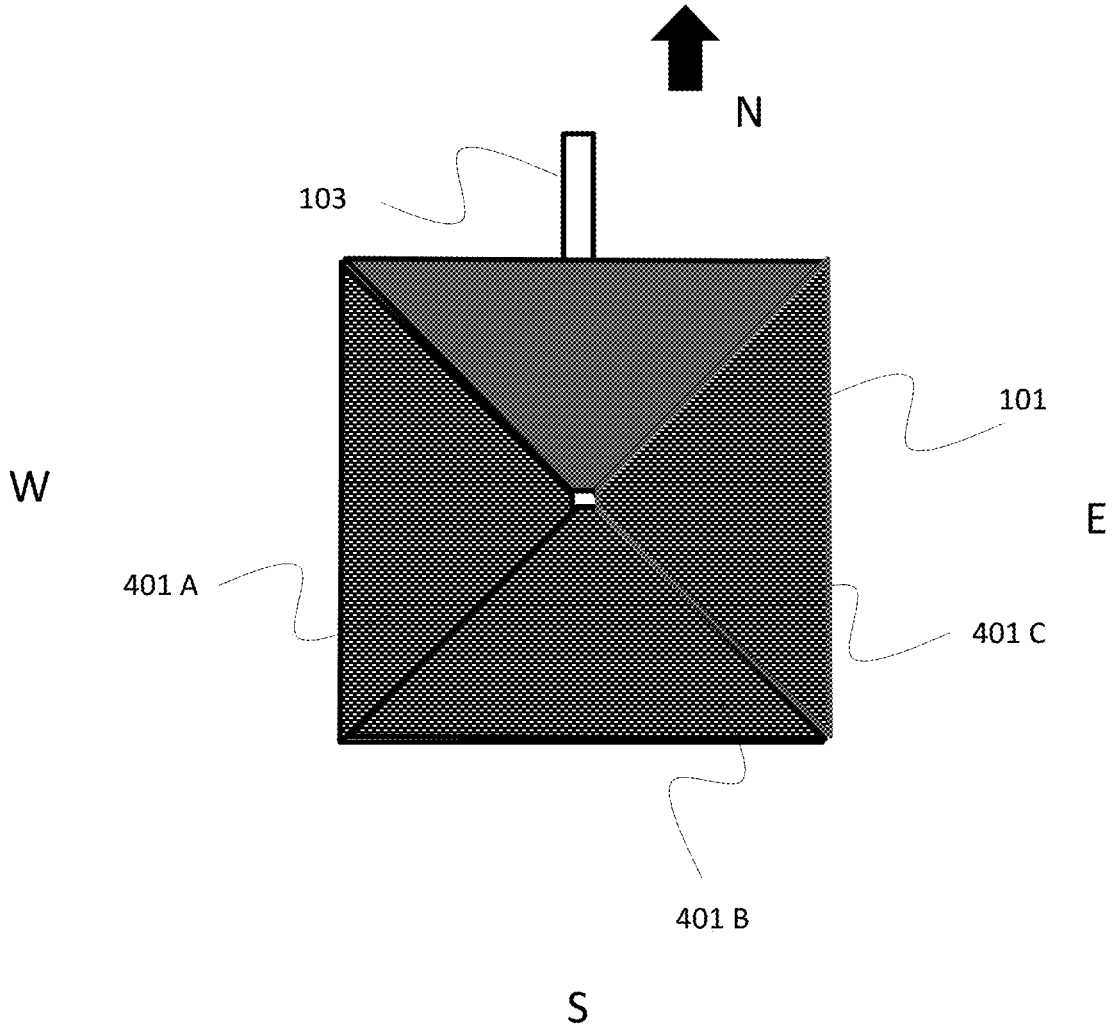
FIG. 5 shows an optimal orientation of the embodiment of FIG. 1.

FIG. 4 is a schematic of the system's components and electrical connections. The three solar panels, 401 A, B and C are connected to a combiner block (403) via conductive means (402). The combiner block (403) is connected to a charge controller (405) operative to direct electrical energy to the storage battery (407) via conductive path 406; and to direct electrical energy from the storage battery via conductive path 406 back to the controller (405) and, in turn, direct electrical energy to an LED light source (409) via conductive path 408.

The solar-powered lighting system is designed to provide nominally 14 hours of light during darkness hours. Rather than using a single solar panel on the top, the system has a novel arrangement of three solar panels (401 A, B, and C) oriented such that 401 A faces west, 401 B faces south, and 401 C faces east. As such, as the sun arcs overhead, an optimal amount of light energy is converted to electrical energy and stored. When used in the southern hemisphere, the light is oriented such that the panel 401 C faces west, 401 B faces north, and 401 A faces east.

Many factors affect the amount of electrical energy converted from sunlight impinging on the solar panels. The angle of sun rays and solar flux varies seasonally, and on foggy days, between 10 and 25 percent of electrical energy is produced compared with sunny days. Thus, the size of the solar panels, their angles with respect to the base, the capacity of the storage battery, and the power consumption of the LED light source all affect the amount of light that can be provided during darkness hours. The time can be increased by increasing the size of the solar panels, for example, or by using a less-bright LED light source.

A system can be construed that would provide optimal light during darkness for the continental United States, for example. As such, a solar-powered lighting system can be designed that will provide 12 or more hours of light during darkness hours for areas on the planet that have the highest population densities. Customized versions can be designed to handle long darkness hours and limited light energy in areas of higher latitudes.

The solar panels, electronic components, and LED light sources are all readily available. The novelty comes by virtue of the solar-panel orientation and the light system's geographical orientation. The housing and base portion can be made of metal or rigid non-metal materials. The light diffuser is made of translucent materials where thickness and weather protection are balanced against reduced light output.

What is claimed is:

1. A solar-powered lighting system comprising:

three triangular solar panels;

a triangular access door;

said triangular solar panels and said triangular access door are connected to a base wherein their apexes converge to form a pyramid structure;

the base comprising a square surface with a circular opening centered with respect to the base's sides;

a cylindrical light diffuser centered with said circular opening of said base;

a combiner block operative to combine the electrical outputs of said three triangular solar panels;

a charge controller operative to direct the electrical energy from said solar panels to a storage battery during daylight hours; and said charge controller operative to direct electrical energy from said storage battery to at least one LED light source.

* * * * *